United States Patent [19]

Renzetti

[11] Patent Number: 4,610,110

[45] Date of Patent: Sep. 9, 1986

[54] SPINDLE MOUNT FOR ROTARY ABRASIVE TOOLS OR THE LIKE

[75] Inventor: Robin Renzetti, Coatesville, Pa.

[73] Assignee: Dunnington Co., Chester Springs, Pa.

[21] Appl. No.: 733,672

[22] Filed: May 13, 1985

[51] Int. Cl.[4] ..... B24B 41/04

[52] U.S. Cl. ..... 51/168; 83/666; 83/676; 409/231

[58] Field of Search ..... 51/166 R, 168; 83/666, 83/665, 663; 409/231, 232, 234; 279/1 L, 16; 403/252, 253

[56] References Cited

U.S. PATENT DOCUMENTS 4,561,217 12/1985 Steyskal ..... 51/168

*Primary Examiner*—Roscoe V. Parker

*Attorney, Agent, or Firm*—Charles A. McClure

[57] ABSTRACT

A self-contained mount, for a spindle-driven rotary abrasive tool or the like, able to compensate for slight non-concentricity of the threading on the end of a drive spindle for the rotary tool. The mount includes an internally threaded cylindrical sleeve with an outside diameter small enough to be inserted into a longitudinal axial bore in such tool, and a retaining ring to maintain the sleeve fixed longitudinally therein while permitting it to adjust its position relative to the rotational axis, if necessary, upon being screwed onto a threaded end portion of the spindle, while supporting the tool coaxially therewith. In a modified version, a backup washer is interposed between the retaining ring and the end of the tool; and in a refinement of such modification a supplementary washer is interposed, with the abutting surfaces of the washer and the sleeve chamfered to fit together so they can adjust in relative position even more readily, to accommodate axial misalignment of the sleeve by the threaded part of the spindle. The preferred embodiment of such refinement utilizes a spherically concave face on the backup washer and a corresponding convex face on the adjacent end of the mounting sleeve, an optimal arrangement for permitting self-adjustment of the sleeve position.

20 Claims, 9 Drawing Figures

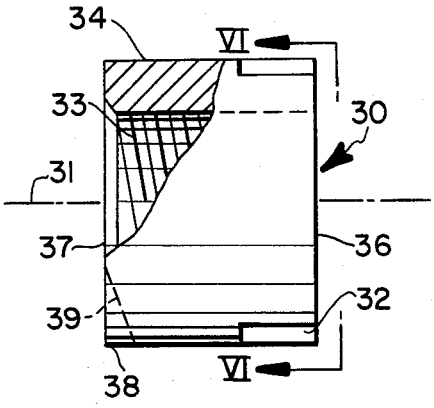
FIG. 5
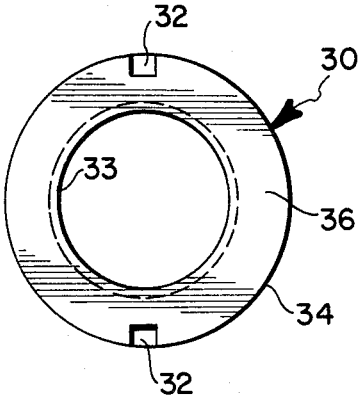
FIG. 6
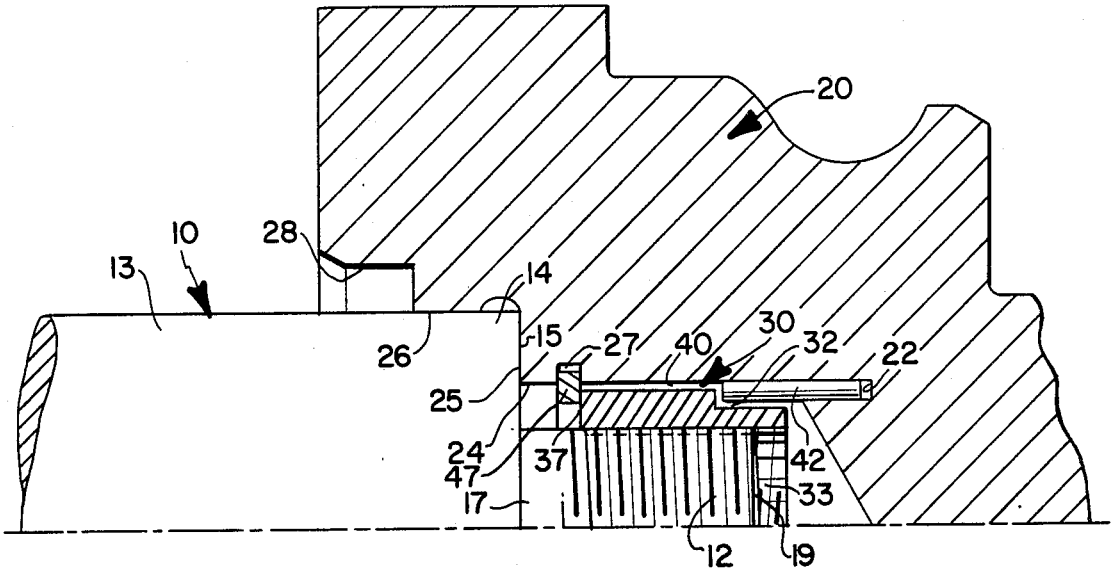
FIG. 7
FIG. 8
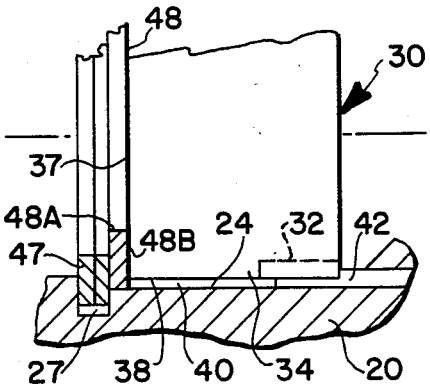
FIG. 9
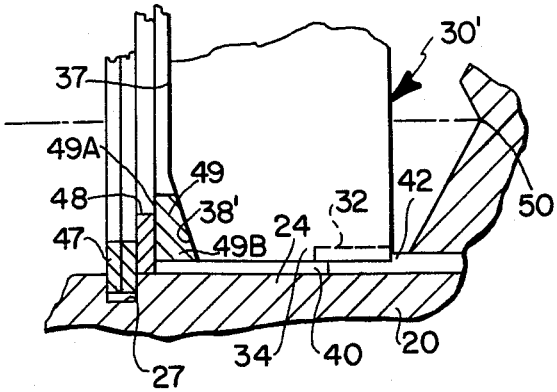

SPINDLE MOUNT FOR ROTARY ABRASIVE TOOLS OR THE LIKE

BACKGROUND OF THE INVENTION

This invention relates to mounting of rotary abrasive tools onto drive spindles, especially by way of intervening mounting means adapted to secure the tool onto a threaded end of the spindle, for rotation about the axis of rotation of the spindle itself, even though the threaded end of the spindle may be somewhat misaligned.

Rotary abrasive tools, which function to shape other (usually rotary) tools or other devices, are necessarily shaped to very close tolerances so that the objects worked thereby are formed as desired. The alignment problem becomes even more critical, if possible, in rotary dressing tools whose function is to restore other abrasive tools to proper condition after some degree of wear.

Frequently a rotary dressing tool is secured to a supporting spindle by being threaded thereonto. Proper alignment between the supporting spindle and the supported dressing tool may be assured by (1) abutment of a positioning face on the tool perpendicular to its axis of rotation against a similarly faced shoulder on the spindle, (2) close fitting of a coaxial circumferential surface on the spindle into a coaxial bore in the dressing tool.

Regardless of how accurately the spindle and the rotary tool are shaped, and however precise the fit is between their respective positioning surfaces, the assembly may be misaligned if the axis of the threaded spindle end fails to be completely concentric with the axis of support of the tool by the spindle. A gross misalignment will prevent assembling the tool onto the spindle, but even a small discrepancy will tend to misalign the tool—if not by total axial offset, then by nonparallellism (tilt or cocking). Adjustable fastening nuts and similar retaining devices are known in a number of applications, but not as having compensated satisfactorily for the alignment problem just described.

SUMMARY OF THE INVENTION

In general, the objects of this invention are accomplished, in a spindle mount for a rotary abrasive tool or the like, by means of an internally threaded cylindrical sleeve small enough to be inserted into a longitudinal axial bore in the tool and to move radially therein, such as off or across the axis, as may be necessitated by noncoaxial threading on the spindle, upon being screwed thereonto, while continuing to support the tool coaxially with the rotational axis of the spindle.

A primary object of the present invention is rotational support of an abrasive tool on a spindle while maintaining concentricity of the tool with the axis of rotation of the supporting spindle.

Another object of this invention is threaded securing of a rotary abrasive tool onto a supporting spindle without affecting their axial alignment despite non-coaxiality of the spindle threads with the rotational axis of the spindle.

A further object of the invention is provision of a dresser or other rotary abrasive tool with pre-installed mounting means adapted to thread onto a supporting spindle, for securing the tool and spindle together and for assuring their axial alignment.

Yet another object of this invention is to accomplish these and other objects of the invention with a minimum of parts and steps.

Other objects of the present invention, together with means and methods for attaining the various objects, will be apparent from the following description and the accompanying diagrams, presented here by way of example, rather than limitation, of the invention.

BRIEF DESCRIPTION OF THE DRAWINGS

FIGS. 5 and 6 are side and end elevations of one component of intervening means for securing the tool of FIGS. 3 and 4 onto the spindle of FIGS. 1 and 2.

FIG. 7 is an axial sectional elevation of the foregoing spindle and rotary tool assembled and secured together by intervening means including the component of FIG. 7 in an embodiment of the invention.

FIGS. 8 and 9 are fragmentary side elevations of modifications in the securing means of preceding views according to this invention.

DETAILED DESCRIPTION OF THE INVENTION

According to this invention, the sleeve of the mounting means includes, at its end to be inserted into the bore of the tool to be supported by the spindle, a plurality of keying recesses adapted to to be engaged—positively for rotation, but loosely to permit axial adjustment—by a like plurality of keying means affixed to the tool near the base of its spindle-receiving bore. The sleeve is adapted, at its opposite end, to abut (slidably) a complementary surface of a ringlike member of the mounting means located at a longitudinally fixed position within and near the open end of the sleeve-receiving bore of the tool.

The supporting spindle has a larger cylindrical body coaxial with its axis of rotation, and the tool has a complementary bore coaxial with its outer working surface. The spindle also has a perpendicular shoulder face adjoining its threaded end portion, and the rotary tool has a like positioning face perpendicular to its axis of rotation. The respective faces abut one another when the tool/sleeve assembly is screwed snugly onto the threaded spindle.

In a modified version, a backup washer is interposed between the retaining ring and the end of the tool; and in a refinement of such modification a supplementary washer is interposed, with the abutting surfaces of the washer and the tool end chamfered to fit together so they can adjust in relative position even more readily, to accommodate axial misalignment of the sleeve by the threaded part of the spindle. The preferred embodiment of such refinement utilizes a spherically concave face on the backup washer and a corresponding convex face on the adjacent end of the mounting sleeve, an optimal arrangement for permitting self-adjustment of the sleeve position.

It will be understood that the rotary tool can be unscrewed from the threaded end of the supporting spindle by simply turning it in the opposite direction from that used in screwing it thereonto.

Figure 1:
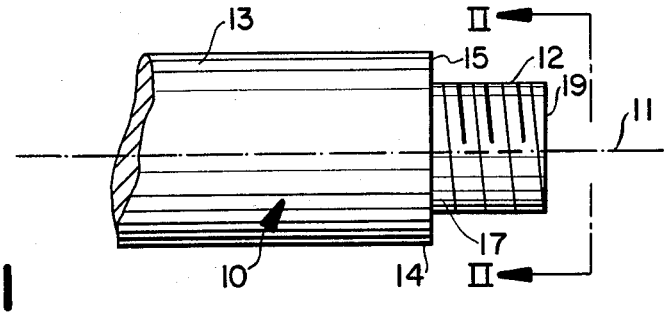

FIG. 1 shows, from the side, spindle 10, which has reduced end portion 12 threaded circumferentially from its free end to unthreaded part 17 adjoining shoulder portion 14 defined by end face 15 and cylindrical body 13. The opposite end portion of the spindle body is cut away for simplicity of illustration. Axis of rotation 11 of the spindle is indicated by a broken line.

Figure 2:
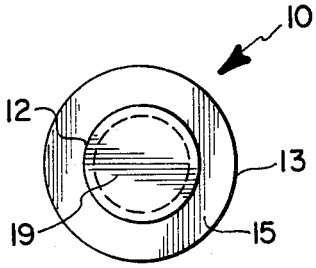
FIGS. 1 and 2 are side and end elevations of an end portion of a spindle suitable for supporting a rotary tool thereon.

FIG. 2 is an end view of spindle 10 taken at II—II on FIG. 1.

Figure 3:
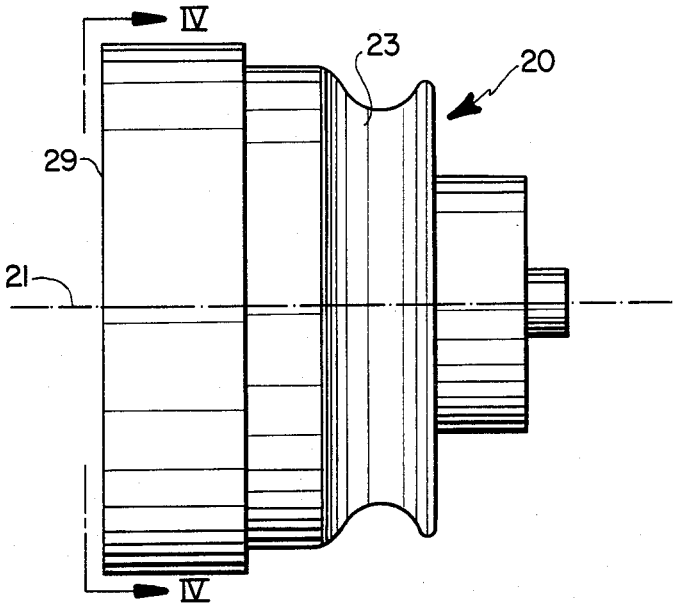
FIGS. 3 and 4 are side and end elevations of a rotary tool to being supported for rotation on a spindle such as that of the preceding views.
Figure 4:
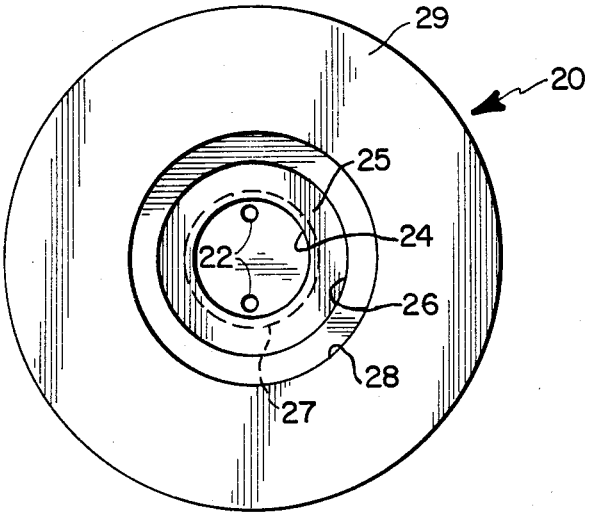

FIGS. 3 and 4 show in like manner (FIG. 4 being taken at IV—IV on FIG. 3) rotary abrasive tool 20, which has a complex outline, such as is suitable for dressing an abrasive tool to be used on a complex shaped part of a cutting tool or the like. Rotary tool 20, with rotational axis 21 shown by a broken line, has a progressive multiple bore structure, including small, medium, and large concentric bores 24, 26, and 28 in that order outward from the axis. Narrow flat face 25 intervenes perpendicularly between the open ends of bores 24 and 26. Also visible are a pair of smaller non-concentric bores 22 parallelling one another at opposite sides in the base of bore 24. Near its open opposite end, bore 24 has circumferential slot 27 to receive a retaining ring (discussed below).

FIG. 5 shows, from the side, hollow cylindrical sleeve 30, the most prominent member of the mounting means of this invention, with part of one corner (upper left) sectioned away to show its interior. This end 37 of the sleeve is squared off, but alternatively may be chamfered on its outside corner 38, as shown by a broken line at 39. Inner surface 33 of the sleeve is threaded, whereas outer surface 34 is smooth except for pair of keying recesses 32 (only one visible), extending from opposite end 36 of the sleeve along a minor part of its length.

FIG. 6 shows sleeve 30 from recessed end 36, as taken at VI—VI on FIG. 5. The depth (radially) and the width (circumferentially) of recesses 32 are larger than the diameter of a keying dowel to be received therein, so as to facilitate assembly and to provide room for radial displacement of the sleeve unhindered by the dowels. Of course, the keying is rotationally effective to ensure that the rotary tool and the sleeve turn together, as when (after assembly) they are screwed onto the threaded end of a supporting spindle, such as spindle 10.

FIG. 7 shows, in axial sectional elevation, rotary tool 20 assembled onto spindle 10 (not sectioned) with intervening mounting means, including sleeve 30 threaded onto end portion 12 of the spindle. Dowels 42 (one visible) extend fron non-concentric bores 42 (one visible) in the base of tool bore 24 into recesses 32 (one visible) in the sleeve, at its right end. Retaining ring 47 fits along its outer edge into retaining slot 27 near the open end of small concentric bore 24 in rotary tool 20, and between nearby face 15 of spindle shoulder 14 at its left and (at its right) left end 37 of the sleeve. The ring surrounds but clears unthreaded part 17 of spindle end 12. Annular gap 40, between outer surface 34 of the sleeve and the wall of surrounding bore 24, provides adjustment clearance for the sleeve.

FIGS. 8 and 9 show fragmentarily, from the side, the lower part of sleeve 30 (unsectioned), along with adjacent retaining components (sectioned), corresponding to additional embodiments of the present invention.

FIG. 8 adds backup washer 48 in small concentric bore 24 of rotary tool 20 and between retaining ring 47 and sleeve end 37. The backup washer is flat, with its face 48A against the retaining ring, and its face 48B against the sleeve end. The backup washer aids in distributing assembly pressure more evenly.

FIG. 9 shows a preferred embodiment, with supplementary washer 49 added between backup washer 48 of the preceding diagram and the sleeve. In this washer, face 49A is flat, but face 49B is chamfered on its inner edge, and modified adjacent corner 38' of the sleeve is correspondingly chamfered to fit snugly thereagainst. As shown, the preferred chamfer is arcuate, rather than flat, configuring the supplementary washer surface as concave, and the sleeve corner is complementarily convex. The preferred radius of curvature of the corresponding spherical angle exceeds the length of the sleeve, but not the axial extent of the rotary tool, and is centered on point 50 located within the unbored part of the rotary tool and on the axis. The resulting contiguous convex and concave surfaces are spherically complementary to assure optimum performance of the sleeve assembly.

Assembly of the self-adjusting or "floating" mount components and the supported rotary dresser or similar abrasive tool, on the one hand, and assembly of the tool/mount assembly onto a supporting spindle, on the other hand, normally take place as two separate and distinct operations; (A) assembly of the self-adjusting or "floating" mount into the tool is a one-time operation conveniently accomplished in conjunction with manufacture of the tool, whereas (B) assembly of the mount (carrying the rotary tool) onto a spindle occurs whenever the tool/mount assembly is to be used on another spindle. Details of the respective assembly operations, with reference numerals, follow.

A. Assembly of the mount components with the rotary tool:

(a) dowels 42 are pressed into bores 22 at base of bore 24 in tool 20;

(b) end 36 (with recesses 32) of sleeve 30 is inserted into bore 24 of tool 20 and rotated manually to position dowels 42 in recesses 32;

(c) whatever washer(s) is(are) used is(are) placed into bore 24 also;

(d) retaining ring 47 is compressed to enter bore 24 and positioned so that the peripheral part of the ring enters slot 27 in the bore.

Done in conjunction with the manufacturing of the rotary tool, these steps result in provision of such a tool with a pre-installed mount, ready for assembly onto a threaded supporting spindle end and adapted to compensate automatically for misalignment of spindle threading.

B. Assembly of the rotary tool, with mount, onto the spindle:

(a) bore 24 of rotary tool 20 is placed over threaded end 12 of spindle 10 in position to thread sleeve 30 onto threaded end 12;

(b) with spindle 10 prevented from rotating, tool 20 is rotated to screw onto the spindle and to receive cylindrical body 13 of the spindle into mating bore 26 of the tool;

(c) face 15 of spindle shoulder 14 is juxtaposed snugly to face 25 of the rotary tool by further screwing of the tool/sleeve assembly onto the threaded end of the spindle.

It will be understood that, as the last step takes place, sleeve 30 can—and will—be axially reoriented if the threaded surface on spindle end portion 12 is non-parallel to the orienting cylindrical surfaces and/or non-perpendicular to the flat positioning faces on spindle 10 and rotary tool 20. Thus, the sleeve may move bodily within annular gap 40 to adjust to threaded spindle end portion 12, if and as the threaded axis is offset from or cocked across the rotational axis. The sleeve is constrained at its end 36 to the extent that dowels 42 touch the sides of circumferentially wider recesses 32 in outer surface 34 of the sleeve, and it is constrained at its opposite end 37 by sliding frictional contact, whether directly with retaining ring 47 or with flat backup washer 48 or preferably against supplementary washer 49.

Adjustment by angular cocking (as distinct from simple parallel offsetting) relative to the designed axis is greatly facilitated by the preferred complementary spherically concave conformation of the supplementary washer and adjacent convex corner modification of the sleeve. Otherwise, uneven pressure is applied against the retaining ring and/or intervening flat backup washer, which may lead to uneven wear and shortened operating life of the assembly.

It will be understood that the rotary tool will be held most securely on the spindle by this adaptable securing means, as compared with completely fixed mounting means; indeed, more securely because the retention pressure will be more evenly distributed. Additional advantages and benefits of this self-adjusting threaded spindle mount for rotary abrasive tools or the like will become fully apparent to those who undertake to practice the present invention as shown and described.

Various embodiments of this invention have been suggested above, together with their relative merits. It also will be apparent that, for example, the backup washer and supplementary spherical washer could be combined or that the specified dowels could be replaced by alternative keying means with like effect. Other modifications may be made, as by adding, combining, deleting, or subdividing parts or steps, while retaining some of the advantages and benefits of the invention—which itself is defined in the following claims.

I claim:

1. In a spindle mount for a rotary abrasive tool or the like onto a threaded spindle end, the improvement comprising a sleeve with a given outside diameter, sufficiently less than the diameter of an axial bore in such tool to be adapted to be inserted thereinto and to be aligned therewithin other than strictly coaxially; the sleeve, at the end thereof to be inserted deepest into such bore, being adapted to be engaged by rotative keying means fixed relative to such tool; the opposite end surface of the sleeve being adapted to abut a complementary surface of ringlike means located at a longitudinally fixed position within the open end of such bore; the sleeve being threaded internally and thereby adapted to screw onto the threaded end of such a spindle, to bear against the inbore side of such ringlike member, and thereby to move the tool further onto the spindle until an adjacent shoulder on such spindle abuts a complementary face on such tool; the sleeve being thereby adapted to align itself coaxially with such threaded spindle end within such bore despite non-concentricity of threading on the spindle end relative to the axis of rotation of the spindle body.

2. Spindle mount according to claim 1, wherein the ringlike means comprises a flat retaining ring insertable into a retaining slot in the bore of the rotary tool, and the abutting end of the sleeve is perpendicular to the longitudinal axis of the sleeve.

3. Spindle mount according to claim 2, wherein the ringlike means comprises also a flat backup washer fitting against the retaining ring further within the bore of the rotary tool.

4. Spindle mount according to claim 2, wherein the ringlike means comprises also a supplementary washer having a flat side adjacent and parallel to the retaining ring but further within the bore of the rotary tool and having its other side chamfered along its inner corner, and the abutting end of the sleeve is chamfered along its outer corner complementary to the chamfered surface of the retaining ring.

5. Spindle mount according to claim 4, wherein the chamfered side of the supplementary washer is spherically concave along its inner corner, and the abutting chamfered end of the sleeve is spherically convex along its outer corner complementary to the concave surface of the supplementary washer.

6. Spindle mounting means for a rotary abrasive or like tool having an axial bore adapted to receive therein a threaded spindle end, the bore being provided with means near its base for keying to such rotary member, and the bore being slotted inside near its open end to receive a retaining ring, the tool also having a concentric wider and shallower positioning bore adapted to receive a cylindrical portion of the spindle body therein; the mounting means comprising a retaining ring adapted to fit around the spindle end and into the slot in the smaller bore of the tool; a hollow cylindrical sleeve having a given outside diameter, sufficiently less than the diameter of the smaller bore in such tool to be inserted thereinto and to be realigned therewithin by the threaded portion if other than strictly coaxial with the spindle axis; part of the circumferential surface of the sleeve, at the end thereof to be inserted deepest into such bore, being complementarily configured to be engaged rotatively by the keying means in such tool bore; the opposite end surface of the sleeve being chamfered on its outside corner and thereby adapted to abut the chamfered inside edge of washer means adjacent the retaining ring, the sleeve being internally threaded and thereby adapted to screw onto the threaded end of such a spindle, to force the washer means toward the ring, thereby to move the tool further onto the spindle until a perpendicular positioning face on such tool comes into contact with a similar positioning face on an adjacent shoulder on such spindle; the sleeve being thereby adapted to align itself and the rotary tool carried thereby coaxially with such spindle despite non-coaxiality of such threaded end of the spindle relative to the axis of rotation of the spindle itself.

7. Spindle mounting means according to claim 6, wherein the chamfered edge of the washer means is concave, and the chamfered corner of the sleeve is convex, each such curved surface having a radius of curvature centered on the common axis of rotation within the body of the rotary tool when assembled onto the spindle

8. Spindle mounting means according to claim 7, including a flat backup washer between the retaining ring and the flat side of the spherical washer means and contiguous with both.

9. Spindle mounting means according to claim 9, wherein the keying means comprises a plurality of dowels, and the complementary configuring of the sleeve comprises a like plurality of recesses correspondingly located, each dowel being smaller radially than the corresponding recess and spaced radially from the surface thereof.

10. Method of spindle mounting a rotary abrasive tool including pre-mounting the tool onto the claim 1 mounting means, the pre-mounting assembly procedure comprising the following steps:

(a) providing rotational keying means in an axial bore of the tool;

(b) inserting a hollow sleeve into the axial bore and positioning the sleeve to receive the keying means of the tool thereinto; and (c) compressing a retaining ring and inserting it into the bore, and positioning the ring therein so that the peripheral part of the ring enters a retaining slot in the bore adjacent the end of the sleeve opposite its keyed end.

11. Method of spindle mounting a rotary abrasive tool according to claim 10, including also the following steps:

(d) placing the axial bore of the rotary tool over the threaded end of the spindle in position to thread the sleeve onto the threaded end of the spindle;

(e) preventing the spindle from rotating, and rotating the tool/sleeve assembly to screw it onto the spindle and to draw the cylindrical body of the spindle into the mating bore of the tool; and (f) snugly juxtaposing complementary faces of the spindle shoulder and the rotary tool by screwing the tool/sleeve assembly further onto the threaded end of the spindle.

12. Method of spindle mounting a rotary abrasive tool, already pre-mounted on means according to claim 11, onto a threaded drive spindle whose threaded end is not quite coaxial with the spindle's rotational axis, including retaining the sleeve longitudinally fixed relative to the tool via the retaining ring, and displacing axially at least one end of the sleeve from concentricity with the rotational axis of the spindle itself by action of non-concentricity of the spindle threads during threading thereof onto the spindle end.

13. Method of securely assembling an axially bored rotary abrasive tool onto means adapted to mount the rotary tool coaxially on a threaded end portion of a drive spindle, the mounting means including an internally threaded hollow cylindrical sleeve adapted to undergo limited radial movement so as to compensate for minor non-concentricity of the supporting spindle threading, relative to the axis of rotation of the spindle body, the method comprising:

(a) providing rotational keying means in an axial bore of the tool;

(b) inserting the sleeve into the axial bore and positioning the sleeve to receive the keying means of the tool thereinto; and (c) compressing a retaining ring and inserting it into the bore and positioning the ring therein so that the peripheral part of the ring enters a retaining slot in the bore adjacent the end of the sleeve opposite its keyed end.

14. Method of assembling a rotary abrasive tool and mounting means according to claim 13, including also the step of pre-inserting keying means into the tool bore to accomplish step (a).

15. Method of mounting the rotary abrasive tool and mounting means assembled according to claim 14 onto a supporting spindle having a shoulder and an adjacent threaded end portion, comprising the following added steps:

(d) placing the axial bore of the rotary tool over the threaded end of the spindle in position to screw the internally threaded sleeve onto the threaded end of the spindle;

(e) preventing the spindle from rotating, and rotating the tool/sleeve assembly to screw it onto the spindle and to draw the cylindrical body of the spindle into the mating bore of the tool; and (f) snugly juxtaposing complementary faces of the spindle shoulder and the rotary tool by screwing the tool/sleeve assembly further onto the threaded end of the spindle.

16. Method of spindle mounting a rotary abrasive tool according to claim 15, including also, in combination therewith, the step of interposing a washer between the longitudinally constraining means and the adjacent end of the hollow cylindrical restraining means.

17. Method of spindle mounting a rotary abrasive tool according to claim 16, including also, in combination therewith, the steps of chamfering the adjacent inner corner of such an interposed washer, and chamfering the adjacent external corner of the retaining means complementarily so as to enable them to slide relative to each other while securing the assembly together.

18. Method of spindle mounting according to claim 17, wherein the adjacent inner corner of the washer is chamfered concave, and the outer corner of the retaining means is chamfered correspondingly convex, with a radius of curvature centered on the axis of rotation of the rotary tool and concentric with the spindle rotational axis.

19. Method of equipping a rotary abrasive tool to be supported coaxially on a threaded drive spindle despite non-concentricity of the spindle threading with the axis of rotation of the spindle, comprising the steps of assembling to the rotary tool mounting means including a sleeve adapted to be screwed onto the threaded spindle, retaining the sleeve longitudinally fixed but radially adjustable relative to the tool for screwing onto non-concentric threading of a drive spindle, and keying the sleeve rotatively to the tool.

20. Rotary abrasive tool equipped to be supported on a threaded drive spindle by being assembled according to claim 19 to mounting means including a sleeve adapted to be screwed onto the threaded spindle, the sleeve being retained longitudinally fixed but radially adjustable relative to the tool for screwing onto non-concentric threading of a drive spindle, and being keyed rotatively to the tool.

* * * * *